United States Patent [19]

Carruthers

[11] 4,134,355

[45] Jan. 16, 1979

[54] SNAG-RESISTANT ANCHOR

[76] Inventor: John A. Carruthers, 30 Coates Ave., Auckland, New Zealand

[21] Appl. No.: 792,218

[22] Filed: Apr. 29, 1977

[30] Foreign Application Priority Data

May 6, 1976 [NZ] New Zealand ..... 180787
Aug. 23, 1976 [NZ] New Zealand ..... 181828

[51] Int. Cl.[2] ..... B63B 21/38
[52] U.S. Cl. ..... 114/297; 114/304
[58] Field of Search ..... 114/301, 302, 303, 304, 114/305, 306, 307, 308, 309, 310, 298, 299, 297; 24/241 S, 11 SF, 201 TR

[56] References Cited

U.S. PATENT DOCUMENTS

| | | | |
|---|---|---|---|
| 2,007,667 | 7/1935 | Stubbs | 114/307 X |
| 2,948,249 | 8/1960 | Gesner et al. | 114/303 X |
| 3,450,088 | 6/1969 | Guier | 114/304 X |
| 3,463,112 | 8/1969 | Zakaitis et al. | 114/298 |

FOREIGN PATENT DOCUMENTS

| | | | |
|---|---|---|---|
| 2538510 | 8/1976 | Fed. Rep. of Germany | 24/201 TR |

*Primary Examiner*—Trygve M. Blix

*Assistant Examiner*—Sherman D. Basinger

[57] ABSTRACT

The invention relates to an anchor which includes an anchor head having flukes thereon and a shaft to which at an outer end thereof an anchor warp is connected. The shaft is pivotally mounted with the head of the anchor and is formed having an elongate primary shaft pivotally connected with the head at an inner end and having a recess therewithin which mounts, in normal operation a secondary shaft which has its inner end connected with the anchor head. An adjustable and resettable release mechanism is mounted on an outer end of the primary shaft in such a position that in normal operation an outer end of the secondary shaft may engage with the release mechanism and be held thereby yet upon more than a predetermined strain being applied to the primary shaft such as on the anchor snagging on the sea bed, the primary shaft is moved pivotally, to disengage the primary shaft from the secondary shaft outer end to permit the primary shaft to pivot freely relative to the anchor head and secondary shaft and enable the primary shaft to move substantially above the anchor head and to pull the anchor head and flukes out backwards from snagged position.

7 Claims, 6 Drawing Figures

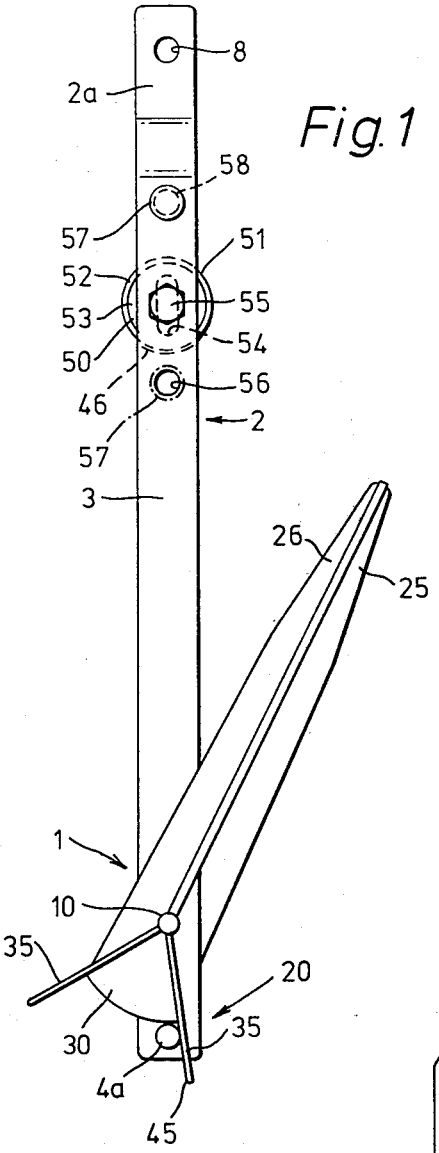
Fig. 1
Fig. 2
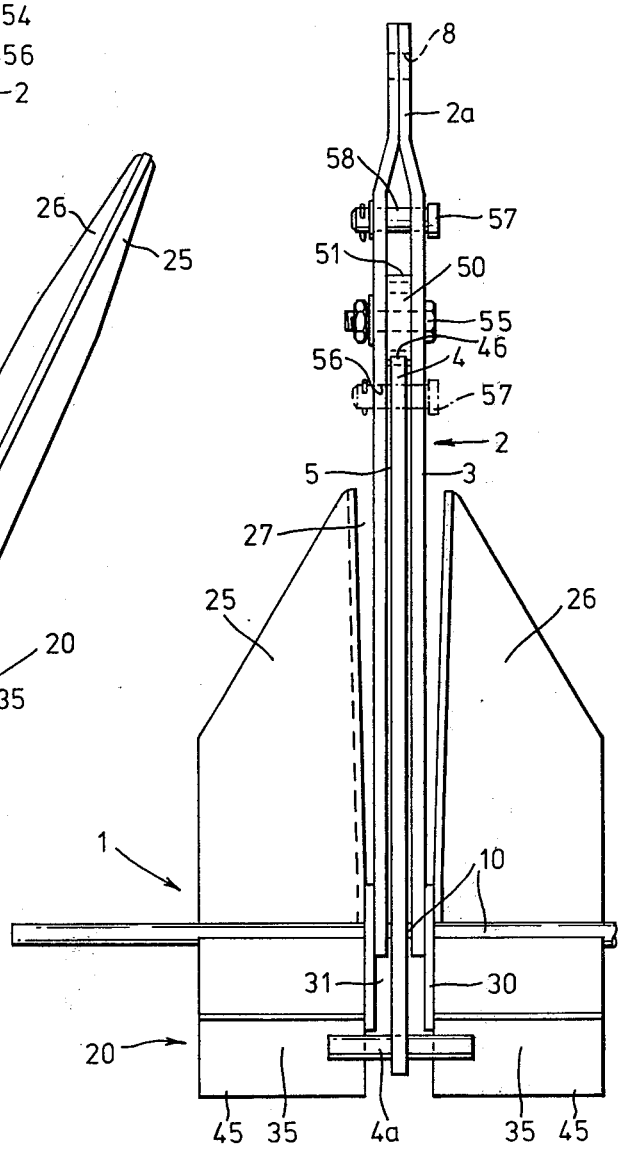

SNAG-RESISTANT ANCHOR

This invention relates to anchors and more particularly to anchors which are adapted to resist and as far as possible prevent snagging on the sea bed, lake bottom and the like, when in use.

Up until this time, numerous anchors, such as for example anchors and especially smaller anchors for pleasure craft, when used in some areas upon the sea bed or lake bed, tend to snag and are unable to be lifted. Alternatively, they take substantial time to free from a snagged condition, this making anchors potentially dangerous in use, in a number of circumstances. When permanently snagged and therefore unable to be lifted, such snagging may require a user to cut or destroy an anchor wrap, thereby not only loosing a majority or large part of an anchor warp, but also an anchor chain and the anchor.

It is an object of this invention to overcome as far as possible these problems and to at least provide the public with a reasonable choice.

Other objects of this invention will become apparent from the following description.

According to one aspect of this invention there is provided an anchor including an anchor head and a shaft; the anchor head and shaft being pivotally connected relative to one another, and capable of a releasable engagement therebetween, whereby on a predetermined strain being applied thereto, said head and shaft are released so as to permit free movement therebetween.

According to a further aspect of this invention there is provided an anchor including a head and a primary shaft; the primary shaft being pivotally connected relative to said head; a secondary shaft being also connected relative to said head, the secondary shaft being releasably engaged with said primary shaft, and the engagement being such that on a predetermined strain being applied to the anchor the secondary shaft is released from the primary shaft to permit said primary shaft to move and pivot freely relative to the secondary shaft and head.

The invention will now be described by way of example, with reference to the preferred embodiment and two alternative embodiments and with reference to the accompanying drawings, in which:

FIG. 1 is a side view of an anchor according to one form of the invention.

FIG. 2 is a plan view of an anchor according to the form of the invention shown in FIG. 1 of the drawings.

Figure 3:
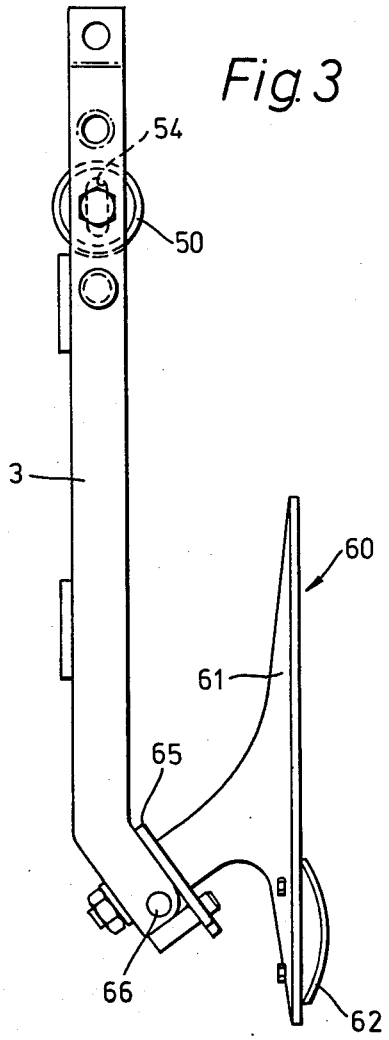
FIG. 3 is a side view of a further form of an anchor.

In the present invention, reference to "the head" of an anchor is to be defined as the "end" of the anchor, having flukes, weights and the like.

Referring firstly to FIGS. 1 and 2 of the accompanying drawings, the preferred embodiment of the anchor will now be described.

The anchor 1 as shown in FIGS. 1 and 2 of the accompanying drawings includes a shaft 2 formed as a primary shaft 3 and a secondary shaft 4. The primary shaft 3 is provided with a hollow recess 5 along the length thereof, and is substantially bifurcated in formation. An outer end 2a thereof is provided with a suitable bore or hole 8 passing therethrough, for the attachment of a chain, warp and the like (not shown).

Within the recess 5 of the first or primary shaft 3 is provided the secondary shaft 4, an elongate pivot shaft 10 being provided adjacent inner ends of the primary and secondary shafts 3 and 4 and through a head 20 of the anchor 1, to permit pivot movement of the primary and secondary shafts 3 and 4 relative to the head 20 of the anchor 1.

In this preferred embodiment of the invention the head 20 of the anchor 1 is provided with two spaced apart flukes 25 and 26, said flukes 25 and 26 defining a recess 27 therebetween and substantially parallely aligned cheek plates 30 being provided on inner sides thereof, and defining a recess 31 therebetween. The secondary shaft 4 and primary shaft 3 extend into the recess with the secondary shaft 4 extending past the pivotal location on the pivot shaft 10 of the primary shaft 3 and the inner end of the secondary shaft 4 is provided with an elongate bar or "T" section 4a at an extension end thereof.

The cheek plates 30 are provided between stop plates 35 and extend substantially parallely with said primary and secondary shafts 3 and 4 and are provided with stop plates 35 on opposing outer edges thereof extending across said cheek plates in such a position that the inner or extension end, cross bar or "T" section 4a of the secondary shaft 4 may pivot between said stop plates and then be limited from further movement. In the preferred form of the invention cheek plates and stop plates are mounted from adjacent surfaces of the flukes 25 and 26 and are preferably integrally formed therewith.

In the preferred form of the invention as shown in FIGS. 1 and 2 of the accompanying drawings fluke extensions 45 such as for example angled "Y" extensions extend outwardly from a face of the flukes 25 and 26 so as to increase the fluke area for the purposes of control and effectiveness. Such a fluke increase, can be used in conjunction with the present invention or as an effective means of increasing fluke area, in comparison with other anchors. The increase in fluke area also services to spread any load and pressure upon the flukes, to behind the pivot point or line of the flukes 25 or 26.

A release mechanism 50 is provided, mounted to the primary shaft adjacent an outer end thereof and within the recess 5. The release mechanism 50 in the preferred embodiment of the invention is provided in the form of an adjustable resettable cam friction surface 51 which is provided as an outer annular casing 52 of a substantially hard material such as for example tubular metal and within said outer annular casing 52 is provided a resilient inner member 53 providing a slotted aperture 54 therethrough, through which a fixing means 55 engages said release mechanism 50 with the primary shaft 3. Thus, it will be appreciated that the release mechanism 50 is mounted within the recess 5 of the primary shaft 3 and the slotted hole 54 may be orientated to enable the cam or friction surface 5 to be moved longitudinally relative to the primary shaft 3. An outer end 46 of the secondary shaft 4 is adapted to come into contact wth the release mechanism 50 such that it may frictionally engage with the cam surface 5 such that in normal conditions the release mechanism will maintain the secondary shaft 4 in position relative to the primary shaft 3 substantially within the recess 5 yet upon a more than predetermined strain being placed upon the release mechanism 50 such as for example by snagging of the anchor the resilient inner member 53 compresses enabling the outer annular casing 52 to move away from said outer end 46 sufficiently for the release mechanism to disengage from the outer end 46. It will be appreciated that longitudinal adjustment of the release mechanism 50 relative to the primary shaft 3 and outer end 46 will vary the degree of compression required to be imparted to the inner member 53 before the release mechanism disengages the outer end 46.

In an alternative embodiment of the invention the release mechanism is provided in the form of a shear pin (not shown) engaged within normally aligning apertures provided in adjacent outer ends of the primary and secondary shafts 3 and 4. The shear pin is provided of a material of sufficient strength such that it may shear upon the more than predetermined strain being applied between the primary and secondary shafts 3 and 4 and it is preferred that a soft metal or a suitable plastics material is utilized for the shear pin.

Bores or holes 56 are provided along the mid portion of the primary shaft 3 and through the secondary shaft 4, such that when said primary shaft 3 and secondary shaft 4 are engaged with the secondary shaft 4 within the recess 5 a locking means, in the preferred form a toggle pin 57 or nut and bolt can be passed therethrough. In use, when the anchor is to be used with the quick release mechanism, the toggle pin or locking means 57 will be located in an upper housing bore 58 where it will be out of the way, however, if it is desired to leave the anchor in a locked position and it is not desired that the anchor have the release facility or capability, the locking means 57 will be removed from the upper bore 58 and passed through the bores 56 in the primary and secondary shafts 3 and 4 to lock the primary and secondary shafts 3 and 4 in position relative to one another and neutralize any quick release mechanism.

In normal use however, it is desired that the anchor be used and have the quick release capability provided by the invention so as to overcome any snagging tendencies. In use, and for example when the anchor is snagged and is unable to be weighed normally, the vessel to which it is attached moves over the anchor in the substantially normal manner so as to tighten an anchor warp and to raise the primary and secondary shafts relative to the head by pivoting said shafts about the pivot shaft of the head. Strain is then applied to the anchor warp either by a ground swell raising the vessel or by further pulling on the anchor warp which brings the inner end of the secondary shaft into contact with one stop plate such as indicated in FIG. 1 of the accompanying drawings. Upon further strain being applied to the anchor warp, the frictional contact between the upper end of the secondary shaft and the release mechanism will pass a predetermined point should the anchor not normally dislodge, at which time the primary shaft will free itself from the outer end of the secondary shaft and will be able to pivot freely relative to the secondary shaft and the head of the anchor. In this way it will be seen that the primary shaft can pivot relative to the anchor up to about 180 degrees. This pivoting enables the primary shaft to move over the head of the anchor and to pull the anchor out by the head and to release the flukes from a snagged position.

An alternative method of raising the anchor is provided by moving the vessel hard astern whilst the anchor is engaged with the sea bed, whereupon increased strain upon the anchor warp as a result of the vessel moving astern causes the release mechanism to release and enable the flukes to trip over and pull out backwards and whereafter once the flukes are disengaged from the sea bed continued astern movement of the vessel will cause the anchor to hydroplane to the surface whereupon it may be weighed without substantial effort.

Once the anchor has been withdrawn from the water, it can be reassembled and the release mechanism may be readily reset or alternatively the locking means may be inserted through the primary and secondary shafts to hold the primary and secondary shafts in the predetermined or fixed positions relative to one another.

Figure 4:
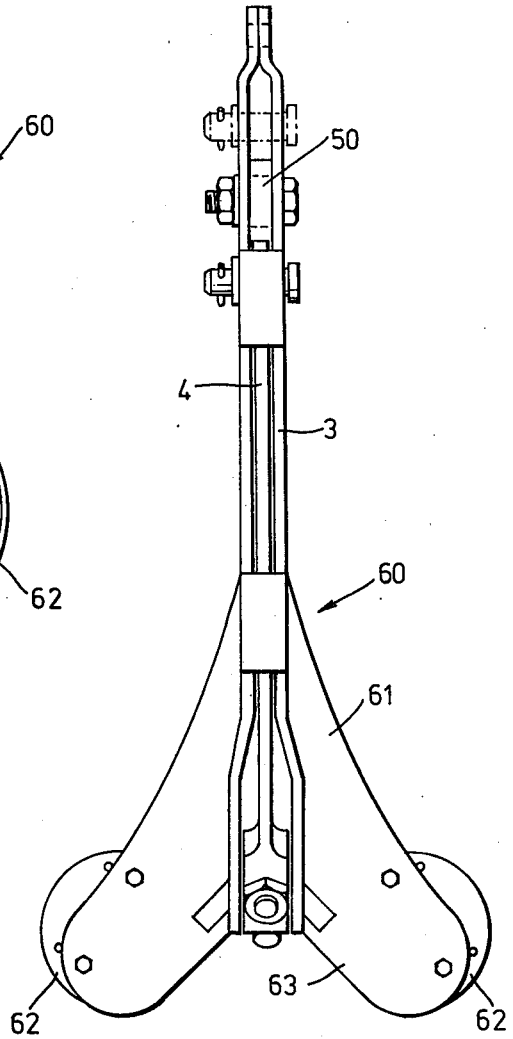
FIG. 4 is a plan view of the anchor shown in FIG. 3 of the drawings.

Now referring to FIGS. 3 and 4 of the accompanying drawings, in this form of the invention an anchor head 60 is provided having flukes 61 in a substantially known plough formation, the head 60 having a primary shaft 3 extending upwardly therefrom, the primary shaft 3 having a quick release mechanism such as hereinbefore described, such as in the form of a friction block or cam block 50 which engages an upper end of a secondary shaft 4.

However, in the form of the invention shown in FIGS. 3 and 4 of the accompanying drawings, the anchor head 60 is provided with a recessed or concave underside, which can house a turntable 65 which engages with a nut and bolt, through an end of the shaft, so that the head 60 of the anchor and flukes are rotatable relative to the shaft. Alternatively, the rotatable turntable 65 is on top of the head, linked to the shaft.

In this way, added advantages are gained, and it makes it easier for freeing snagged anchors and the like, as in addition to the quick release mechanism which will free the first and second shafts, and thus enable the first shaft to pivot or rotate freely by up to about 360 degrees, it will also enable the shaft to rotate relative to the head of the anchor.

In the form of the invention shown in FIGS. 3 and 4 of the accompanying drawings, the primary shaft is rotatably pivoted about a housing such as shown in FIG. 3 of the accompanying drawings by means of a pivot pin, bolt and the like 66, the secondary shaft 4 running up the slot of the first shaft 3 and frictionally engaging with the release mechanism 50 such as described in earlier forms of the invention. On a boat moving over the anchor, arms of the shaft will come into contact with stop surfaces, to thus apply friction to the engagement between the end of the secondary shaft and the friction block, to thus release the first shaft from the second shaft, to enable free movement therebetween and relative to the head of the anchor.

In the form of the invention shown by way of example in FIG. 4 of the accompanying drawings, it is envisaged that the ends of the flukes 61 can be extended or bulbous, being integrally formed with the main fluke portion or alternatively can be provided with adjustable bulbous extensions, flaps, body extensions and the like 62, to extend the area covered by the ends of the flukes, this facilitating an extension of the end portions of the anchor, so that the heads 63 of the flukes 61 will rest further above the ground, thus allowing the points to enter into the sea bottom or lake bottom. It is envisaged that the bulbous extension formations 62 may be provided with slotted holes and holes may also pass through the edges of the anchor flukes, such that on bolts, adjustable securing means and the like passing therethrough, the amount of extension can be varied depending upon the desires of a user.

Figure 5:
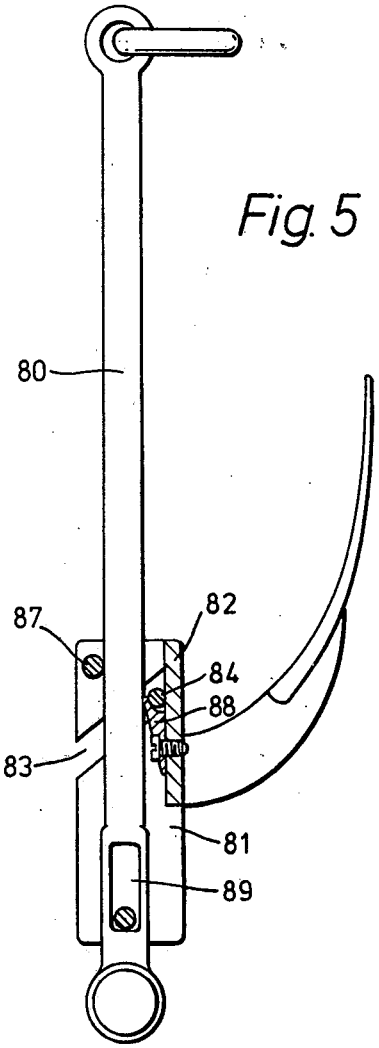
FIG. 5 is a side view of an anchor of a further form of the invention.
Figure 6:
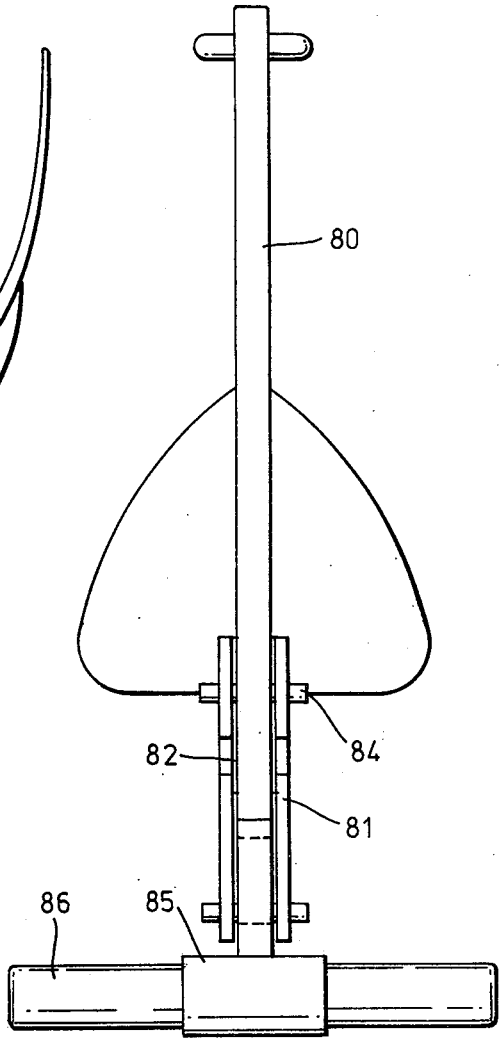
FIG. 6 is a plan view of the form of anchor shown in FIG. 5 of the drawings.

Referring now to FIGS. 5 and 6 of the accompanying drawings, in this embodiment of the invention an elongate primary shaft 80 is shown pivotally connected to or adjacent a secondary shaft 81 and a head 82 of an anchor.

The secondary shaft 81 is additionally provided with an engaging recess or groove 83 therein and the underside of the primary shaft 80 is provided with a locating member 84 which in this form of the invention is adapted to releasably engage within the engaging groove 83. This release in this form of the invention and as shown in FIGS. 5 and 6 is by way of fractional size variations between the engaging groove 83 and the locating member 84 and a resilient finger member 88 having an end portion engageable over the locating member 84 when in a normal position but deflectable when said locating member 84 releases from said groove 83. However in alternative embodiments of the invention the release means may be provided by way of a crank or restriction within the engaging groove 83 or by a shear pin, frangible rubber bush and the like. It will be appreciated that in normal circumstances the head 82, the secondary shaft 81 and the shaft 80 will remain in predetermined positions relative to one another as shown in FIGS. 5 and 6. However, upon a more than predetermined strain being placed on the anchor such as for example by a vessel moving over the snagged anchor the member 84 will be caused to disengage and move outwardly of the engaging groove 83 and to thus enable the primary shaft 80 to move and pivot freely relative to the secondary shaft 81 and the head 82. It will be appreciated from FIGS. 5 and 6 of the accompanying drawings that the primary shaft 80 is pivoted about a point relative to the head 82 so that on the primary shaft 80 being released from the secondary shaft 81 it is able to pivot freely up to about 360 degrees relative to the head and secondary shaft.

Apertures 87 such as for example apertures adapted to locate stop or locking bolts and the like are provided on the secondary shaft adjacent the head 82 and it is provided that if desired a locking lug or bolt may be passed through the apertures 87 to lock the primary shaft 80 in a locked or predetermined position relative to the secondary shaft 81 and the head 82.

Securing or attachment means 85 is provided about the head and primary shaft for the attachment of floats 86 to ensure that the anchor when dropped orientates itself on the sea bed with the fluke downwardly directed for engagement with the sea bed.

It will be appreciated therefore that the present invention provides means whereby the shaft and head of an anchor are able to be moved freely relative to one another, such as for example up to 360 degrees and in some cases between 90 and 180 degrees. Up until the time anchors have been provided with some release mechanisms, which provide for restricted movement of the shafts and heads relative to one another.

For example, it has been known to provide anchors which have shafts which are able to move up to 90 degrees relative to the head of anchors. However, it is restrictive in operation, in that the further the head and shaft can pivot relative to one another the better the release possibilities there are and the more effective the release from snagged conditions. This is obtained from the present invention.

It will be appreciated that the anchors have been described by way of example only with reference to the preferred embodiments and alternative embodiments and may be constructed of any desired material for example metal and the like. Modifications and improvements may be made to the invention without departing from the scope or spirit thereof.

I claim:

1. An anchor having an anchor head including two spaced apart flukes mounted on a pivot shaft, a pair of parallely aligned cheek plates provided on inner sides of said flukes and providing a recess therebetween, inner ends of primary and secondary shafts engaged pivotally with said pivot shaft within the recess, said cheek plates mounting a stop plate thereon against which an inner end of the secondary shaft can pivot, an outer end of the primary shaft mounting a release mechanism which releasably engages an outer end of the secondary shaft with said primary shaft, said primary shaft and secondary shaft able to pivot until the inner end of the secondary shaft contacts said stop plate and upon a predetermined strain being placed thereon an outer end of the secondary shaft is forced to disengage from the release mechanism to enable the primary shaft to move freely relative to the secondary shaft.

2. An anchor including a head and a shaft, said shaft including a primary shaft pivotally connected relative to the head and a secondary shaft also being connected relative to the head, said secondary shaft being releasably engaged with said primary shaft via a release mechanism mounted between said primary shaft and said secondary shaft, characterized in that said release mechanism is adjustable and resettable so that an operator may vary a predetermined strain at which said release mechanism releases said secondary shaft relative to said primary shaft, and wherein the release mechanism includes a resilient member, a fixing means provided to mount said release mechanism with said primary shaft, an outer end of said secondary shaft being correspondingly shaped to engage over said release mechanism and to engage therewith until a predetermined strain compresses said resilient member sufficiently to enable said outer end of said secondary shaft to disengage therefrom, to permit said primary shaft to move and pivot freely relative to said secondary shaft and head.

3. An anchor as claimed in claim 2 wherein the primary shaft is provided with a hollow recess therein, within which said secondary shaft and said release mechanism situates, said release mechanism outer surface providing a cam friction surface located within the recess of the primary shaft, against which the outer end of the secondary shaft comes into contact, to frictionally engage therewith, so that in normal conditions the adjustable and resettable release mechanism will retain the secondary shaft in position relative to the primary shaft.

4. An anchor as claimed in claim 3 wherein said resilient member is provided with a slotted aperture therein, through which said fixing means is engaged, said slotted aperture facilitating moving said release mechanism longitudinally relative to said primary shaft and said secondary shaft outer end, to facilitate adjustment of said predetermined strain at which said release mechanism releases.

5. An anchor as claimed in claim 2 wherein said primary and said secondary shafts are capable of being locked relative to one another by a locking means, engageable with said primary and said secondary shafts.

6. An anchor as claimed in claim 5 wherein said head is in the form of a plough.

7. An anchor as claimed in claim 2 wherein said head is in the form of a plough.

* * * * *